US006087964A

United States Patent [19]

Allen et al.

[11] Patent Number: 6,087,964

[45] Date of Patent: Jul. 11, 2000

[54] VEHICLE DETECTOR WITH OPERATIONAL DISPLAY

[75] Inventors: Robert S. Allen; Thomas R. Potter, Sr., both of Reno, Nev.; Thomas W. Seabury, Diablo, Calif.

[73] Assignee: Reno A & E, Reno, Nev.

[21] Appl. No.: 08/847,777

[22] Filed: Apr. 24, 1997

[51] Int. Cl.[7] ..... G08G 1/01

[52] U.S. Cl. ..... 340/941; 340/933; 235/384; 701/117; 701/118

[58] Field of Search ..... 340/941, 933, 340/934, 936, 937; 235/384; 701/117, 118

[56] References Cited

U.S. PATENT DOCUMENTS

| | | | |
|---|---|---|---|
| 3,943,339 | 3/1976 | Koerner et al. | 340/941 |
| 4,392,119 | 7/1983 | Price et al. | 340/941 |
| 4,668,951 | 5/1987 | Duley et al. | 340/941 |
| 4,720,681 | 1/1988 | Sinclair | 324/339 |
| 4,829,546 | 5/1989 | Dueckman | 340/541 |
| 5,153,525 | 10/1992 | Hoekman et al. | 340/941 |
| 5,278,555 | 1/1994 | Hoekman | 340/941 |
| 5,512,891 | 4/1996 | Kang | 340/941 |
| 5,523,753 | 6/1996 | Fedde et al. | 340/941 |
| 5,680,123 | 10/1997 | Lee | 340/937 |
| 5,734,338 | 3/1998 | Hoekman et al. | 340/941 |

*Primary Examiner*—Jeffery A. Hofsass
*Assistant Examiner*—Sihong Huang

[57] ABSTRACT

A programmable vehicle detector with operator actuatable function selection and parameter value setting keys, and an operational display. A small cluster (four) of key switches enables an operator to select programmable vehicle detector functions, such as pulse/presence, scanning/non-scanning, end of green control; and also adjust the value of settable parameters, such as loop frequency, sensitivity, delay time, and maximum presence time. The value of certain parameters is displayed, either by manual interrogation by operation of the switches during a set mode or automatically during normal operation. During normal operation, the display also indicates dynamically the relative value of the loop inductance, using a unique bar graph, the generation of Call a signal, and the time remaining in a delay time period and a maximum presence time period. The display further indicates which of several channels has been selected for function and parameter programming, or is currently being monitored for operation. The vehicle detector can be operated as both a scanning multi-channel detector or a non-scanning multi-channel detector.

44 Claims, 7 Drawing Sheets

| | |
|---|---|
| FIG. 4A. | FIG. 4B. |
| FIG. 4C. | FIG. 4D. |

VEHICLE DETECTOR WITH OPERATIONAL DISPLAY

BACKGROUND OF THE INVENTION

This invention relates to vehicle detectors used to detect the presence or absence of a motor vehicle in an inductive loop embedded in a roadbed.

Vehicle detectors have been used for a substantial period of time to generate information specifying the presence or absence of a vehicle at a particular location sometimes termed a detection zone. Such detectors have been used at intersections, for example, to supply information used by an associated traffic control unit to control the operation of the traffic signal heads, and have also been used to supply control information used in conjunction with automatic entrance and exit gates in parking lots, garages and buildings. A widely used type of vehicle detector employs the principle of period shift measurement in order to determine the presence or absence of a vehicle in or adjacent the inductive loop mounted on or in a roadway. In such systems, a first oscillator, which typically operates in the range from about 10 to about 120 Khz is used to produce a periodic signal in a vehicle detector loop. A second oscillator operating at a much higher frequency is commonly used to generate a sample count signal over a fixed number of loop cycles. The relatively high frequency count signal is typically used to increment a counter, which stores a number corresponding to the sample count at the end of the fixed number of loop cycles. This sample count is compared with a reference count stored in another counter and representative of a previous count in order to determine whether a vehicle has entered or departed the region of the loop in the time period between the previous sample count and the present sample count.

The initial reference value is obtained from one or more initial sample counts and stored in a reference counter. Thereafter, successive sample counts are obtained on a periodic basis, and compared with the reference count. If the two values are essentially equal, the condition of the loop remains unchanged, i.e., a vehicle has not entered or departed the loop. However, if the two numbers differ by at least a threshold amount in a first direction (termed the Call direction), the condition of the loop has changed and may signify that a vehicle has entered the loop. More specifically, in a system in which the sample count has decreased and the sample count has a numerical value less than the reference count by at least a threshold magnitude, this change signifies that the period of the loop signal has decreased (since fewer counts were accumulated during the fixed number of loop cycles), which in turn indicates that the frequency of the loop signal has increased, usually due to the presence of a vehicle in or near the loop. When these conditions exist, the vehicle detector generates a signal termed a Call signal indicating the presence of a vehicle in the loop.

Correspondingly, if the difference between a sample count and the reference count is greater than a second threshold amount, this condition indicates that a vehicle which was formerly located in or near the loop has left the detection zone. When this condition occurs, a previously generated Call signal is dropped.

Call signals are used in a wide variety of applications, including vehicle counting along a roadway or through a parking entrance or exit, vehicle speed between preselected points along a roadway, vehicle presence at an intersection controlled by a traffic control light system, or in a parking stall, and numerous other applications.

In addition to the basic function of generating and dropping a Call signal, existing vehicle detectors incorporate other features, some of which are selectable by a technician. For example, in order to avoid the false generation of a Call signal, some existing vehicle detectors are provided with a Call delay feature which requires that the vehicle be present in the detection zone for a minimum time period before the vehicle detector is permitted to generate a Call signal (in order to screen out false Calls). Further, some vehicle detectors incorporate a maximum presence function which permits a Call signal to persist for only a maximum period of time, after which the Call signal is automatically dropped (typically to prevent a vehicle stalled over a loop from continuing to generate a Call signal). Still other vehicle detectors incorporate an end of green function which requires the detector to automatically reset after the green traffic signal, which controls the lane in which the loop associated with the vehicle detector is located, terminates. Some vehicle detectors are provided with an extension time feature which extends the Call signal for a period of time after a vehicle leaves the associated loop (typically in order to permit ample minimum time for a vehicle to clear an intersection). Some vehicle detectors are also provided with a presence/pulse selection feature, which causes the vehicle detector to generate one of two types of Call signals: a continually persisting signal so long as the vehicle remains in the loop (the presence function); or a fixed length pulse generated when the vehicle is detected in the loop (the pulse function). Still other vehicle detectors are provided with selectable different sensitivity settings, which enable a technician to adjust the response of the vehicle detector when connected to the loop in order to accommodate a range of detection conditions.

In the past, all such selectable features have been implemented in vehicle detectors using manually settable switches, such as those found in a dual inline package (DIP switches). Because such switches provide only a fixed number of possible combinations, the number of selections available for each feature has been constrained by the use of DIP switches. While this does not necessarily pose a problem with some features, such as the pulse/presence selection or the end of green function (which require only one switch), the variety of choices available for the other features has been severely limited. In addition to this constraint, the use of mechanical switches creates a reliability problem due to the fact that switch contacts become corroded in the severe environment in which vehicle detectors are typically installed, and due further to the fact that the reliability of even new switches is not 100 percent. Even individual testing of each new switch obtained from a manufacturer does not always uncover defects in operation. This problem is compounded by the fact that vehicle detectors must be cost competitive in the marketplace, which creates a bias in favor of using the least expensive switch available.

In the past, vehicle detectors have been designed as either single channel or multiple channel detectors. A single channel detector is designed and configured to operate with only a single loop zone; while a multiple channel vehicle detector is designed and configured to operate with two or more independent loop zones. Multiple channel detectors are designed to be either scanning or non-scanning detectors. A scanning detector operates by sampling only one loop channel at a time, shutting down the active loop, sampling the next loop channel, shutting down that loop, etc. Scanning detectors are typically used in installations in which the probability of cross-talk between loop circuits is more than minimal. Cross talk results when physically adjacent loops are operating at, or near, the same frequency. Cross talk is minimized or eliminated by operating physically adjacent loops on different frequencies. Non-scanning vehicle detectors are configured and function to monitor each of the multiple loop zones simultaneously. Non-scanning detectors are typically used in installations in which there is a very low or no possibility of cross-talk between the multiple loop circuits, such as installations at which the loops are physically separated by a distance sufficient to ensure no overlapping or intercoupling between the electrical fields associated with the loops.

Vehicle detectors are typically installed in locations at which severe environmental conditions occur. For example, over a 24-hour period, the temperature of the loop environment in many locations can vary from well below freezing to well above 100° F. Such temperature variations affect the operating frequencies of the loop oscillator circuit. In addition, humidity conditions vary widely over time and also affect the operating frequencies of the loop oscillator circuit. In order to provide adequate separation in the operating frequencies between physically adjacent loops, vehicle detectors have been provided with different selectable loop frequencies, using DIP switches or the like. The problems noted above with the use of such switches are equally applicable to this frequency select feature. In addition, this arrangement suffers from the disadvantage that those capacitors which are inserted into the oscillator circuit by closing the mechanical switches remain electrically connected to ground even when the oscillator circuit is shut down. An adjacent loop and oscillator circuit can still be adversely affected by such electrical connections.

During typical operation of a vehicle detector, momentary and long term power outages are experienced, and loops are electrically shorted or opened, either on a momentary basis or on a permanent basis. In order to provide some measure of the past operational condition of a given vehicle detector circuit, visible indicators (typically LEDs) and associated circuits have been used to indicate a past loop failure. Typically, the LED is connected to a flashing circuit, which in turn is controlled by a control unit within the vehicle detector, and which causes the visible indicator to flash if a loop failure occurred in the past. While useful to a technician inspecting a vehicle detector, this loop failure feature provides no statistical information, such as the number of failures since the last inspection, or the type of failures (i.e., open loop or shorted loop). In addition, when the detector is physically removed from the site and taken to a repair or replacement location, the illumination of the indicator stops and no further information exists regarding the past loop failure.

In view of the above, a need exists for a vehicle detector capable of improved performance over vehicle detectors of the known type.

SUMMARY OF THE INVENTION

The invention comprises an improved vehicle detector which provides several advantageous features not present in known detectors, improves the performance and selectability of known features in known vehicle detectors, which is relatively simple to operate and highly reliable in operation.

In one aspect, the invention comprises a programmable vehicle detector having an operational display and a small number of program keys, typically three to six keys, with associated switches accessible at a front control panel which enable a technician to select a relatively large number of parameter choices which are displayed by means of an operational display also located on the vehicle detector control panel. This combination of key programmability and operational display enables a technician to initially install a vehicle detector at a particular location, initially program the individual vehicle detector parameters (e.g. frequency, sensitivity, delay and extension time, etc.), check the performance of the vehicle detector under actual traffic conditions, and easily program any desired corrections (e.g. to the loop frequency, sensitivity, or any other parameter). In addition, the operational display is controlled by the vehicle detector to indicate the functional status of the vehicle detector and the progress of a specific function, such as Call signal generation (e.g. delay time remaining, extension time remaining). In addition to providing a wide selection of programming parameter choices for those features found in some known vehicle detectors, the invention also provides optional programmable novel features, such as a display of loop operating frequency for each loop zone associated to the vehicle detector, which ensures that physically adjacent loops are operating on different frequencies, a display of total loop inductance L, and a display of the change $\Delta L$ in loop inductance due to the existing vehicle presently located in the detection zone as a percentage of total loop inductance without the vehicle present. A unique bar graph is also provided in the operational display which displays the amount of inductance change beyond the threshold caused by the vehicle located in the loop zone. This display enables a technician to properly and quickly select the optimum sensitivity setting while observing the response of the detector to actual traffic conditions in order to provide an optimum detection sensitivity for the loop zone.

In another aspect, the invention comprises a vehicle detector having a non-volatile storage device, such as an EEPROM, capable of permanently storing statistical and historical information for subsequent analysis. Examples of such data are the number and type of loop failures over a fixed or variable time period, the length of time of each loop failure, the number of vehicles crossing a loop over fixed or variable time periods, the length of the longest Call signal duration, the number of vehicles within a given speed range over a time period, and the serial number of the vehicle detector. Since the data is stored in non-volatile storage, the information is not lost during a power outage, and thus can be considered highly reliable and is valuable in analyzing the operational history of the vehicle detector.

In another aspect, the invention comprises a vehicle detector which can be programmed to function as either a scanning detector or a non-scanning detector, depending on the requirements of a given installation. This aspect enables a single vehicle detector design to be used for both scanning installations and non-scanning installations, thereby eliminating the need to store two different types of vehicle detector in inventory.

In still another aspect the invention comprises a vehicle detector with an improved oscillator frequency selection circuit in which the capacitors used to selectably determine the magnitude of the oscillator frequency are electrically disconnected from ground when the oscillator circuit is disabled.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
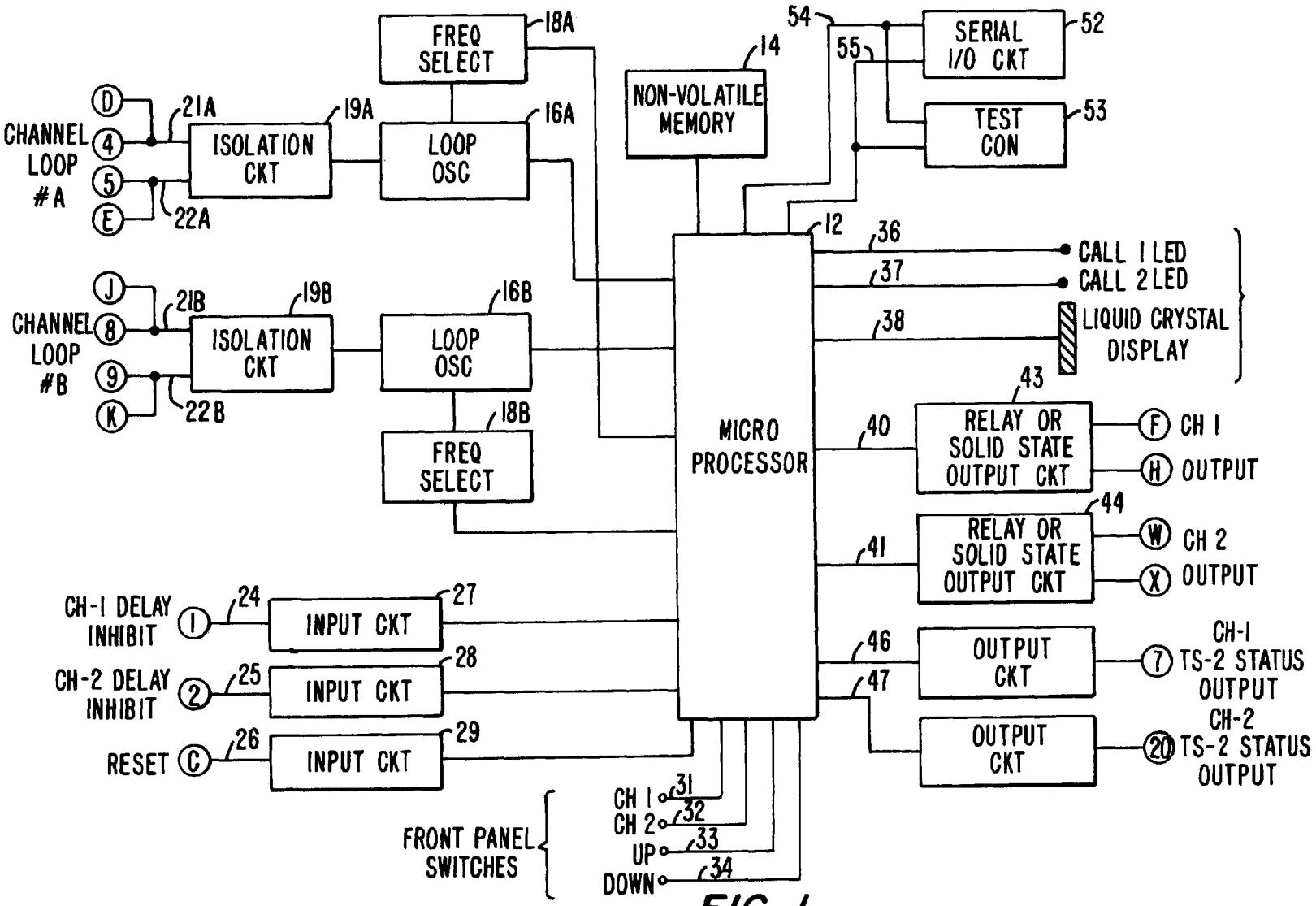
FIG. 1 is a block diagram of a preferred embodiment of the invention.

Turning now to the drawings, FIG. 1 is a block diagram of a preferred embodiment of the invention configured as a two-channel vehicle detector. The term "two-channel vehicle detector" signifies that the vehicle detector is capable of being connected to two separate inductive loops and operating each loop independently. As seen in this figure, a microprocessor 12, preferably a type PIC17C44 microprocessor available from Microchip Technology, Inc., is provided with a non-volatile memory unit 14, preferably a type 24C02A integrated circuit available from Microchip Technology, Inc. Non-volatile memory 14 is used to store programmed parameter settings, as well as certain types of statistical and historical information described more fully below (e.g. total number of loop failures, types of loop failure, and an identifying character such as a serial number for the vehicle detector).

One of the functions of microprocessor 12 is to control the loop oscillator circuit for each channel. More specifically, each channel includes a loop oscillator circuit 16, a frequency select circuit 18, and an isolation circuit 19. For convenience, elements 16, 18 and 19 for each channel are designated with the suffix A or B for the two channels (channel A and channel B). The output of each loop oscillator 16 is coupled via its associated isolation circuit 19 to the external associated inductive loop (not illustrated) by means of a pair of conductors 21, 22. Microprocessor 12 controls the operational status of each oscillator circuit 16, i.e., turns oscillator circuit 16 on or off, as required. Microprocessor 12 further selects the loop frequency by controlling the frequency select circuit 18 in the manner described in detail below.

Microprocessor 12 receives as a first set of externally generated input signals, delay inhibit signals on input terminals 24, 25 for each of the two channels, as well as externally generated reset signals on input terminal 26. The signals on input terminals 24–26 are coupled to microprocessor 12 via three input circuits 27–29 to appropriate input terminals illustrated in FIG. 4 below.

Microprocessor 12 receives a second set of input signals on terminals 31–34 which are coupled to a plurality (four) of manually actuatable normally open switches which are mounted on a control panel illustrated in FIG. 2, described more fully below. The signals on input terminals 31–34 specify the individual channel concerned: i.e., channel 1 (input terminal 31) or channel 2 (input terminal 32), as well as the direction of desired change: i.e., up (terminal 33) and down (terminal 34). The manner in which these signals are used to select channels, select parameters to be adjusted, and adjust the parameters is described more fully below.

Microprocessor 12 has a first pair of output terminals 36, 37 which are connected to individual visual indicators (LEDs in the preferred embodiment) also mounted on the control panel, and each dedicated to one of the two channels. Microprocessor 12 includes a group of output terminals generally designated with reference numeral 38 which are coupled to an operational display (a liquid crystal display in the preferred embodiment) also mounted on the control panel shown in FIG. 2 and described more fully below with reference to FIGS. 2 and 3.

Microprocessor 12 has an additional pair of output terminals 40, 41 for furnishing control signals to a pair of output driving circuits 43, 44. Driving circuits 43, 44 provide conventional relay or solid state output signals for channel 1 and channel 2 respectively. Another pair of output terminals 46, 47 provide conventional status output signals termed TS-2 signals for channel 1 and channel 2, respectively.

An optional serial I/O circuit 52 and a test connector 53 are coupled to the serial data in and data out ports of microprocessor 12 via conductor paths 54, 55, respectively.

Figure 2:
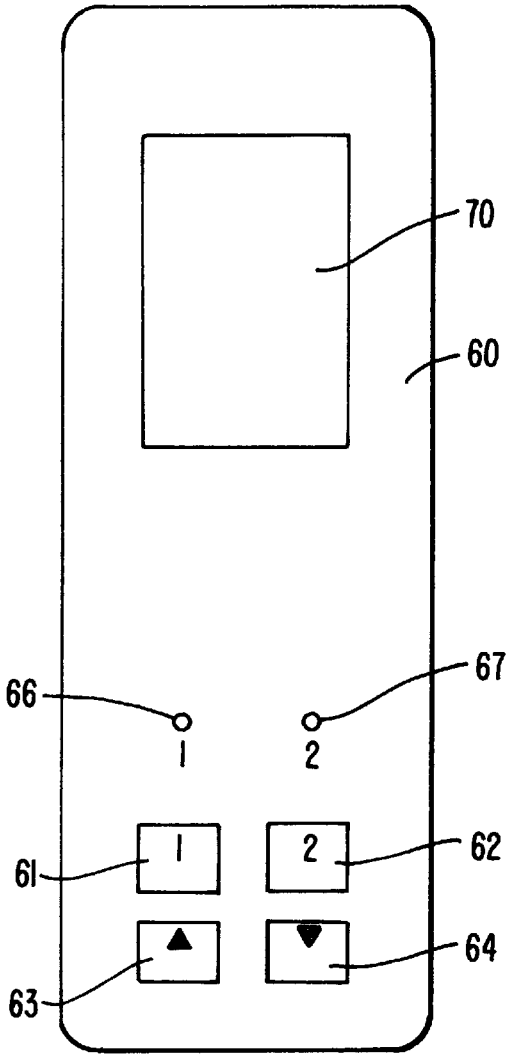
FIG. 2 is a front elevational view of the control panel showing the function switches and display.

The individual components and integrated circuits comprising the units illustrated in block diagram form in FIG. 1 are contained on one or more circuit boards which are attached to a control panel illustrated in FIG. 2. With reference to FIG. 2, control panel 60 includes four manually actuatable normally open touch switches 61–64 which are individually connected to input terminals 31–34 (FIG. 1). A pair of visible indicators 66, 67 (LEDs in the preferred embodiment) are connected to output terminals 36, 37 (FIG. 1) and are illuminated whenever a Call signal is generated by the corresponding channel of the vehicle detector. An operational LCD display 70 is positioned above indicators 66, 67 and provides operational information to the user.

Figures 3, 4:
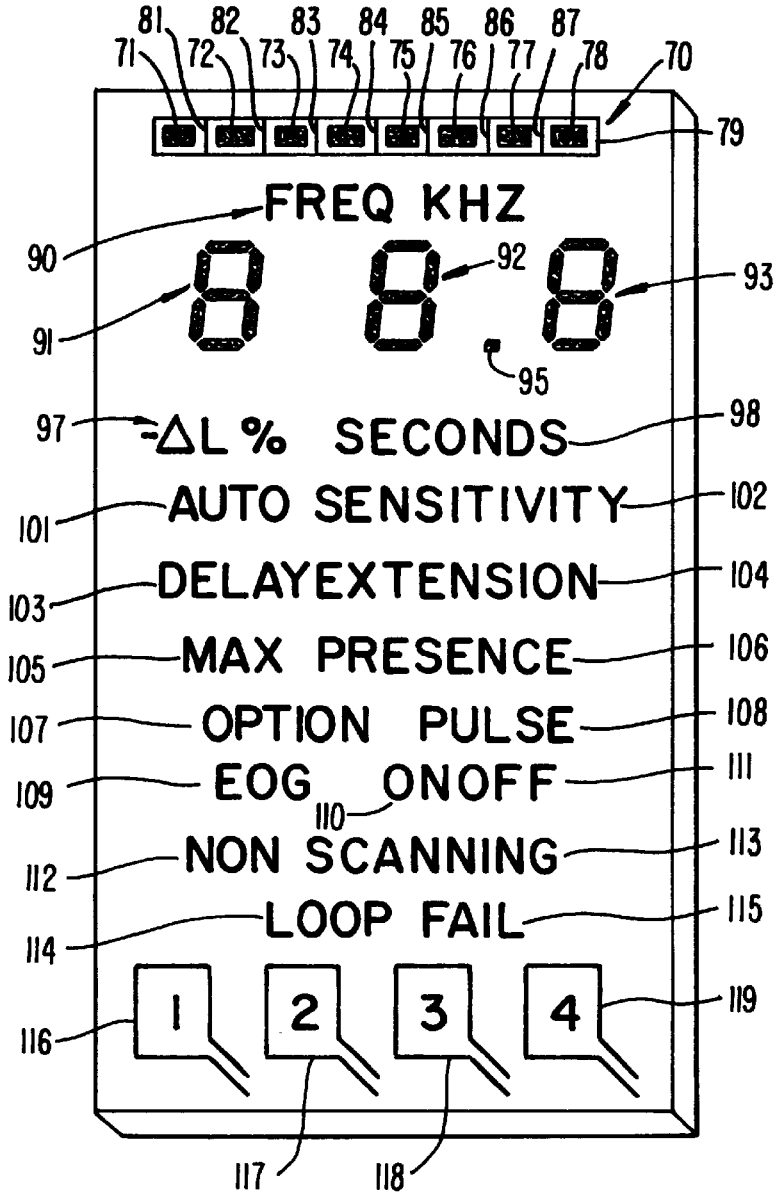
FIG. 3 is front elevational view of the display with all displayed elements enabled.
FIG. 4 is a diagram showing the proper layout for FIGS. 4A–4D, which together comprise a schematic diagram of the preferred embodiment.

FIG. 3 illustrates the entire collection of visible information capable of being displayed by display 70. In FIG. 3, all of the LCD display elements are shown in the activated or visible state. It is understood that the various symbols, characters and messages may be selectively activated using conventional LCD techniques. The various symbols, characters and messages will now be described.

Starting at the top of display 70, a series of rectangular segments 71–78 forming a horizontally arranged bar graph are surrounded by a rectangular border 79 and interstitial vertical bars 81–87. The bar segments 71–78 can be individually activated to the visible state or extinguished; the rectangular border 79 and individual bars 81–87 are illuminated or extinguished together.

Below bar segments 71–78 is the abbreviation for the word "frequency" (FREQ) and the word "kilohertz" (KHZ). Both abbreviations are capable of being illuminated or extinguished as a message 90.

Below the FREQ KHZ message 90 are three seven-segment characters 91–93, with each segment of each seven-segment character being capable of independent control. A small rectangle 95 is positioned between characters 92 and 93 and functions as a decimal point. Below the seven-segment characters 91–93 are a pair of messages: a first message 97—"−ΔL %" and a second message 98 consisting of the word "SECONDS". Messages 97 and 98 are capable of independent control. Below messages 97 and 98 are two messages each capable of independent control: a message 101 consisting of the word "AUTO" and a message 102 consisting of the word "SENSITIVITY". Below messages 101 and 102 are two independently controllable messages 103, 104: message 103 consisting of the word "DELAY" and message 104 consisting of the word "EXTENSION". Below messages 103 and 104 are two independently controllable messages 105, 106: message 105 consisting of the abbreviation "MAX" (for maximum) and message 106 consisting of the word "PRESENCE". Below messages 105 and 106 are two independently controllable messages 107, 108: message 107 consisting of the word "OPTION" and message 108 consisting of the word "PULSE". Below messages 107, 108 are three independently controllable messages 109–111: message 109 consisting of the abbreviation "EOG" (for end of green), message 110 consisting of the word "ON" and message 111 consisting of the word "OFF". Below messages 109–111 are two independently controllable messages 112, 113: message 112 consisting of the word "NON", and message 113 consisting of the word "SCANNING". Below messages 112, 113 are two messages 114, 115: message 114 consisting of the word "LOOP", and message 115 consisting of the word "FAIL". At the bottom of display 70 are four individual symbols 116–119 each enclosing a different number. Symbols 116–119 suggest a vehicle detector loop, and the number enclosed by each symbol 116–119 refers to the corresponding channel. As will be apparent to those skilled in the art, in the two-channel embodiment described herein, symbols 118 and 119 are not used, but are reserved for use with three and four-channel detectors.

Bar segments 71–78 are used in several different ways to provide visual information regarding parameter values and functional operation of the vehicle detector. For example, when adjusting the value of the frequency parameter in the set mode of operation (described more fully below), a loop frequency at the lower end of the selectable frequency range is signified by activation of bar segment 71. A frequency value near the upper range of loop frequencies is indicated by activation of bar segment 78, while a frequency in the middle of the range is signified by activating an appropriate one of bar segments 74, 75. During normal display in the operating mode (described more fully below), segments 71–78 are progressively activated from left to right when a normal vehicle enters the detection zone, and the number of symbols 71–78 activated provides a qualitative indication of the correctness of the sensitivity parameter value, as described more fully below. Message 90 is activated whenever the loop frequency is being displayed by illumination of various ones of the seven-segment characters 91–93 and the decimal point symbol 95. Seven-segment characters 91–93 and decimal segment 95 are used to display time values during the setting of certain of the selectable parameter values (such as delay time, extension time, etc.) and also to display various elapsed times during the vehicle detector operation. In addition, seven-segment characters 91–93 are used to indicate the generation of a Call signal by selectively activating the individual segments as follows:

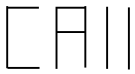

The remaining messages are selectively actuated in the manner described more fully below.

In the preferred embodiment, the programmable functions and specifications are as follows:

Loop Frequency: 8 selectable loop settings (normally in the range of 20 to 100 kilohertz) for each channel. The actual loop frequency value for each setting is displayed when in the set-up mode.

Sensitivity: Vehicle detection results from a sufficient negative change in loop inductance (−ΔL/L). 9 sensitivity levels, plus OFF, are programmable from panel 60 for each channel. These levels are set forth below in the table labeled "Sensitivity & −ΔL/L".

Permanent Call Condition: When set to the "CALL" condition, the channel output is permanently enabled. This condition is indicated by the message "CALL" flashing on the display 70. This option can be selected from the sensitivity selection menu in the set-up mode. This function is useful for verifying controller response when traffic is very light.

Call Delay Time: Adjustable from 0 to 255 seconds in 1 second steps. Timing is digitally derived from the crystal used to drive microprocessor 12. Delay time counts down with remaining time displayed on display 70 starting when the vehicle enters the loop.

Call Extension Time: Adjustable from 0 to 25.5 seconds in 0.1 seconds steps. Timing is digitally derived from the microprocessor crystal. Extension time counts down with remaining time displayed on display 70 starting when the vehicle leaves the loop area.

Modes: Two modes of operation for each channel are programmed from front panel 60.

1. Presence: Has a hold time of 4 minutes minimum (regardless of vehicle size) and typically 1 to 3 hours for an automobile or truck.

2. Pulse: A pulse of predetermined duration is generated for each vehicle detected. Each detected vehicle is instantly tuned out if it remains in the loop detection zone longer than two seconds. This enables detection of subsequent vehicles entering the detection zone. After a vehicle leaves the detection zone, the detector resumes full sensitivity within one-half second.

Scanning: The two loops are activated alternately to minimize cross talk.

Non-Scanning: Where loops are unaffected by cross talk, both channels can be set to non-scanning to improve response time.

Max. Presence Time: Adjustable from 0 to 999 seconds in 1 second steps. Timing is digitally derived from the microprocessor crystal. The maximum presence time can be selected to reset the detector when a vehicle call persists for the preset time or on the next "end of green" (EOG) following the preset time. Max presence time counts down with remaining time displayed on display 70 starting when the vehicle enters the loop detection zone.

Channel ON/OFF State: The channel is off and disabled when set to the OFF position. The channel ON/OFF option can be selected from the sensitivity menu in the set-up mode.

Option 1: In the ON position, display 70 displays the loop inductance value (L) during the "NO CALL" state. In the OFF position, display 70 displays three dashes during the "NO CALL" state.

Option 2: In the ON position, display 70 displays the loop −ΔL/L value whenever a vehicle is detected. In the OFF position, display 70 displays "CALL" when a vehicle is being detected.

Option 3: In the ON position, the detector extends calls only when the green (delay override) signal is present. The OFF position extends all calls.

Option 4: Normal/Fast Response Time. In the ON position, the detector operates with a faster response time.

SENSITIVITY & −ΔL/L

| Sens. | −ΔL/L | Sens. | −ΔL/L |
|---|---|---|---|
| 0 | OFF | 5 | 0.04% |
| 1 | 0.64% | 6 | 0.02% |
| 2 | 0.32% | 7 | 0.015% |
| 3 | 0.16% | 8 | 0.005% |
| 4 | 0.08% | 9 | 0.0025% |

TYPICAL RESPONSE TIMES IN MILLISECONDS (MS.)

| Sens. | Response | Sens. | Response |
|---|---|---|---|
| SCANNING MODE OF OPERATION | | | |
| 1 | 2 ms. | 6 | 32.50 ms. |
| 2 | 2 ms. | 7 | 65 ms. |
| 3 | 4 ms. | 8 | 130 ms. |
| 4 | 8.12 ms. | 9 | 260 ms. |
| 5 | 16.25 ms. | | |
| NON-SCANNING MODE OF OPERATION | | | |
| 1 | 1 ms. | 6 | 16.25 ms. |
| 2 | 1 ms. | 7 | 32.50 ms. |
| 3 | 2 ms. | 8 | 65 ms. |

-continued

| TYPICAL RESPONSE TIMES IN MILLISECONDS (MS.) | | | |
|---|---|---|---|
| Sens. | Response | Sens. | Response |
| 4 | 4 ms. | 9 | 130 ms. |
| 5 | 8.12 ms. | | |

The vehicle detector is provided with certain default settings for the selectable parameters, but these parameters may be changed or programmed by a technician or other operator. In order to view the individual settings, the operator first selects a given channel by depressing the channel 1 switch 61 or the channel 2 switch 62. The symbol 116 or 117 corresponding to the selected channel is then activated. Each time the switch 61 or 62 is momentarily depressed, the identity and current value of a different parameter is displayed. If a switch 61, 62 is not pressed for a predetermined time-out period (three seconds in the preferred embodiment), display 70 reverts to the normal display mode described below. The order in which the parameters are displayed when switch 61 or 62 is sequentially depressed is as follows:

| Step No. | Functions Displayed |
|---|---|
| 1. | Sensitivity level; Presence or Pulse mode |
| 2. | Loop Frequency, Scanning or Non-Scanning mode |
| 3. | Delay Time |
| 4. | Extension Time |
| 5. | Max. Presence Time, End of Green Control (EOG) Off or On |
| 6. | Option 1 Off/On (Displays the inductance value, L, of the loop & feeder Cable) |
| 7. | Option 2 Off/On (Displays the percentage change in inductance, dL/L) |
| 8. | Option 3 Off/On (Off = Extend all calls, On = Extend only on Green) |
| 9. | Option 4 Off/On (Off = Normal operation, On = Fast response) |
| 10. | Loop Fail (Indicates the number of loop failures since the last reset) |
| 11. | Displays the software revision (e.g. C08 - Model C Rev. 8) |

In order to change the parameter values and select various selectable functions, the operator proceeds as follows:

1. Press channel switch 61 or 62 for two seconds to enter the "Set" mode. The loop symbol 116 or 117 activated at the bottom of display 70 indicates which channel is being set. Message 90 is activated. The actual loop frequency is displayed by characters 91–93 and symbol 95 and a single rectangle 71–78 is activated on the bar graph. Press the "UP" switch 63 or "DOWN" switch 64 to increase or decrease the loop frequency. The activated segment in the bar graph box indicates the relative setting (i.e. from left to right—1 to 8).

2. Momentarily press the same channel switch to step to SENSITIVITY. Message 102 is activated. The current sensitivity level is displayed by activating the appropriate segments of character 92 to display a number from one to nine. The sensitivity is changed by pressing the "UP" switch 63 or "DOWN" switch 64. The channel can be disabled by pressing switch 63 or 64 until the "OFF" message is displayed. The lowest sensitivity=1 and highest sensitivity=9. The channel can be programmed to place a permanent call by pressing switch 63 or 64 until the "CALL" message is displayed.

3. Momentarily press the same channel switch to step to DELAY TIME. Messages 98 and 103 are activated. The current value of this parameter is displayed in seconds by characters 91–93. The delay time can be set from 0 to 255 seconds by pressing the "UP" or "DOWN" switches 63, 64. When the time is set to "0", pressing the "DOWN" switch 64 will step to 255 seconds.

4. Momentarily press the same channel switch to step to EXTENSION TIME. Messages 98 and 104 are activated. The current value of this parameter is displayed by characters 91–93 and decimal point symbol 95 in tenths of a second. The extension time can be set from 0.0 to 25.5 seconds by pressing the "UP" or "DOWN" switches 63, 64. When the time is set to "0", pressing the down switch will step to 25.5 seconds.

5. Momentarily press the same channel switch to step to MAX PRESENCE TIME. Messages 98, 105 and 106 are activated. The current selection state (ON or OFF) and value of this parameter in seconds are displayed by characters 91–93. The max presence time can be set from OFF to 999 seconds by pressing the "UP"or "DOWN" switches 63, 64. When the time is set to "OFF" pressing the DOWN switch will step to 999 seconds.

6. Momentarily press the same channel switch to step to PRESENCE/PULSE. Message 106 or 108 is activated depending upon the previously selected mode. Pressing either "UP" or "DOWN" switches 63, 64 toggles between presence or pulse.

7. Momentarily press the same channel switch to step to SCANNING/NON-SCANNING. Messages 112 and 113 or message 113 alone are activated, depending upon the previously selected mode. Pressing either "UP" or "DOWN" switches 63, 64 will toggle between scanning and non-scanning. The Scanning mode is helpful in reducing cross talk. The non-scanning mode provides faster and more predictable response times for greater accuracy in speed and occupancy applications.

8. Momentarily press the same channel switch to step to OPTION "1"—(Display "L"). Character 92 displays the option number. Message 107 is activated. Pressing either "UP" or "DOWN" switches 63, 64 will toggle between "ON" and "OFF" and messages 110 and 111 are alternately activated. Enabling option 1 displays the loop inductance during the "NO-CALL" state.

9. Momentarily press the same channel switch to step to OPTION "2"—(Display "dL/L"). Character 92 displays the option number. Message 107 is activated. Pressing either "UP" or "DOWN" switches 63, 64 will toggle between "ON" and "OFF" and messages 110 and 111 are alternately activated. Enabling option 2 displays the percentage of loop inductance change ($-\delta L/L$) during the "CALL" state.

10. Momentarily press the same channel switch to step to OPTION "3"—(Extend only during Green). Character 92 displays the option number. Message 107 is activated. Pressing either "UP" or "DOWN" switches 63, 64 will toggle between "ON" and "OFF" and messages 110 and 111 are alternately activated. Enabling option 3 extends calls only when the green (delay override) signal is present on input terminal 24 or 25 (FIG. 1). OFF extends all calls.

11. Momentarily press the same channel switch to step to OPTION "4"—(Normal/Fast Response). Pressing either "UP" or "DOWN" switches 63, 64 will toggle between "ON" and "OFF". Enabling option 4 provides faster detector response time. It is recommended that this option only be "On" when the detector is used for speed and/or occupancy applications.

The detector may be reset by an operator in a number of different ways. The operator may proceed as follows:

1. Press the channel switches 61 or 62 continuously for four (4) seconds. After four seconds the channel will have been reset maintaining all previous settings. After the 4 seconds the detector will be in the set mode. To return to the normal display mode, without changing any parameters, simply press the channel switch again for two seconds.

2. Press the channel button 61 or 62 for two (2) seconds to enter the "Set Mode". Once in the set mode, changing the frequency, sensitivity, or other parameters will both enter the new setting and also reset the channel. Simply entering the set mode without changing any parameter will not reset the channel. A parameter must be changed to cause a channel reset when in the set mode.
3. Pressing all four switches 61–64 simultaneously and continuously for five seconds resets both channel and also restores the default settings contained in the program stored in microprocessor 12 to both channels.
4. Loop fail messages 114, 115 are reset only when a complete board reset is performed by either removing the power or following the reset procedure described in the preceding step (3). Resetting the channels one at a time will not reset the loop fail messages.

When setting the sensitivity parameter, additional considerations apply. The sensitivity control sets the sensitivity level for the channel. The sensitivity numbers of (1–9) represent the conventional thresholds which have become widely used and recognized for many years.

| | | |
|---|---|---|
| HI = | "6" | suitable for large loop areas or multiple loops (e.g. 46' × 6' loops) |
| NORM = | "4" | suitable for single 6' × 6' or similar size loop |
| LO = | "2" | suitable for speed or occupancy applications on a single loop |

The available sensitivity levels are 1 to 9 with 1 being the lowest and 9 being the highest. In addition, there are two other modes controlled by the sensitivity control. The sequence is "OFF" 1, 2, 3, 4, 5, 6, 7, 8, 9, "CALL". "OFF" disables the channel output. "Call" permanently enables the channel output. When the message "Call" is flashing on the display 70, it indicates the permanent "CALL" condition.

When setting the maximum presence parameter, additional considerations apply. A call output occurs when either a vehicle is detected (Delay time="0") or after the delay timer in microprocessor 12 has counted to "0" following the arrival of the vehicle. The max presence timer starts timing when a call output occurs. Anytime a call output drops while the max presence timer is timing the max presence timer is reset to the max presence time setting. The max presence timer counts towards zero so long as the call output exists. If the "EOG" (End of Green) control is OFF; the detector channel resets at the time the max presence timer reaches "0". If the "EOG" is ON, the detector channel goes to a "wait state" when the max presence timer reaches "0". The channel remains in the "wait state" until either the call drops, or the green input signal to the channel (termed "delay inhibit" on terminal 24 or 25—see FIG. 1) transitions from the "ON" condition to the "OFF" condition. If the call drops, no reset action occurs. If the max presence timer is in the "wait state" when the green input signal transitions from the "ON" condition to the "OFF" condition, the detector channel is reset with the vehicle over the loop. When the max presence timer is in the"wait state" the MAX PRESENCE-EOG messages 105, 106 and 109 flash on the display 70.

DISPLAY OPERATION

The operation of display 70 proceeds in the following manner. With the detector in the NO CALL state (a Call signal has not been generated) bar graph segments 71–78 are extinguished, the number of the selected sensitivity level is displayed by one of the seven-segment displays 91–93 (the center seven-segment display element 92 in the preferred embodiment), the "sensitivity" message 102 is displayed and the selected one of the two mode messages "PRESENCE" 106 and "PULSE" 108 is activated. In addition, the channel selected for display is indicated by the activation of one of the two loop symbols 116, 117. When a vehicle enters the detection zone, the bar segments 71–78 are progressively activated from left to right of display 70, messages 102 and the selected one of 106 and 108 are extinguished, the"SECONDS" message 98 is activated, the"DELAY" message 103 is activated (if a delay time greater than zero has been selected) and the programmed amount of delay time before registering a Call is displayed by the appropriate ones of seven-segment characters 91–93. As microprocessor 12 counts down the delay time, the displayed amount of delay time remaining changes accordingly.

If a Call signal is generated, the message "CALL" is displayed using seven-segment characters 91–93 by forming the C with character 91, the A with character 92 and the two Ls using the four vertical segments of character 93. In addition, the LED 66 or 67 corresponding to the channel selected for display is illuminated.

When the vehicle departs the detection zone, the "DELAY" message 103 is extinguished, and the "EXTENSION" message 104 is illuminated (if an extension time greater than zero has been programmed by the operator). In addition, the amount of extension programmed by the operator is displayed using seven-segment characters 91–93 and decimal point 95. As microprocessor 12 counts down the extension time, characters 91–93 display the amount of extension time remaining. When the extension time is counted down to zero, the display reverts to the No Call present or standby display mode.

A significant advantage of display 70 resides in the use of the bar segments 71–78 to indicate the relative amount of inductance change when the Call signal has been generated. By merely observing the bar segments 71–78, a technician is informed of the suitability of the sensitivity setting. If too few segments 71–78 are illuminated, this indicates the sensitivity is set too low and will not reliably detect small vehicles, such as motorcycles. If too many of the bar segments 71–78 are illuminated, sensitivity is too high and may register normal vehicles positioned adjacent the detection zone (i.e., in an adjacent traffic lane). Thus, by merely observing the normal operation of display 70 when a normal vehicle enters the detection zone, the technician is capable of determining whether the most appropriate sensitivity setting has been selected and, if not, can enter the set mode of operation at the first available opportunity (when traffic permits) and readjust the sensitivity in the manner described above.

The normal display mode is changed if the max presence function has been selected and the end of green function is unselected. Under these conditions, the "MAX" and "PRESENCE" messages 105, 106 are illuminated. Bar segments 71–78 are progressively illuminated until the Call signal is generated and the appropriate one of LEDs 66, 67 is illuminated. The maximum presence time programmed by the technician is displayed in seconds using multi-segment characters 91–93 and, as microprocessor 12 counts down the time, the time remaining for the max presence time is displayed. If the vehicle leaves the detection zone before the remaining max presence time is counted down to zero, the display reverts to the No Call present or standby mode.

Similarly, if the vehicle remains in the detection zone until the max presence time is counted down to zero, the display reverts to the standby mode.

Whenever a loop failure occurs with display 70 in the standby mode, the "LOOP" and "FAIL" messages 114, 116 are activated. Loop failure is sensed by the vehicle detector by measuring an inductance value which lies outside a normally expected range by a threshold amount in either the positive or negative direction. In the preferred embodiment, this amount is 25% of the current inductance value.

As a variation to the standby display mode of operation described above, microprocessor 12 may be programmed to display the"SCANNING" message 113 or the "NONSCANNING" messages 112, 113 rather than the "PRESENCE" or "PULSE" mode messages 106, 108.

The Option 1 operation (loop inductance L) proceeds as follows. Option 1 controls display 70 during the "No Call" state. When Option 1 is"OFF", display 70 indicates three dashed lines (- - -) during the "No Call" state. Option 1 is selected by the technician, display 70 displays the actual loop inductance using seven-segment characters 91–93 and decimal point symbol 95. The display is done by first displaying "L=" and then the numerical value. The display assumes a value in microhenries. For values greater than 999, the display is done first displaying "L=1", followed by the units, tens and hundreds values. As an example, to display an inductance value of 1,294 microhenries, display 70 alternately displays "L=1" and "294".

Figure 5A:
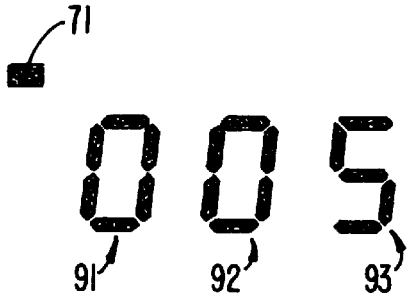
FIGS. 5A–5C are enlarged diagrams of a portion of the display illustrating one of the display features.
Figure 5B:
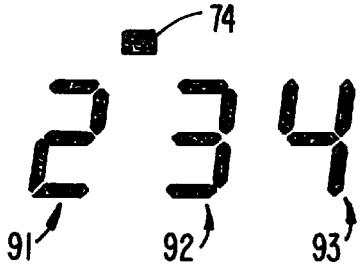
Figure 5C:
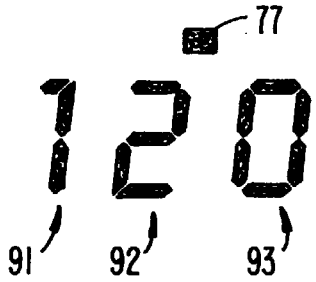

When Option 2 is selected, display 70 displays the percent inductance change caused by the entry of a vehicle into the detection zone using seven-segment characters 91–93 for the numerical value and bar segments 71, 74 or 77 for the decimal point, depending on the order of magnitude of the percentage inductance change. Message symbol 97 is also activated. FIGS. 5A–5C illustrate three examples of the display of the numerical percentage including the decimal point. FIG. 5A is an example of an inductance percentage change less than 1.0 percent signified by illuminating bar segment 71 to indicate the decimal point and seven-segment characters 91–93 to provide the proper numerical value. FIG. 5B illustrates an example of an inductance percentage change in the range from 1 percent to 9.99 percent in which the decimal point is indicated by illuminating bar segment 74. FIG. 5C illustrates an example of percentage inductance change greater than 9.99 percent which is signified by illuminating bar segment 77 to indicate the placement of the decimal point.

An important aspect of the invention is the provision of the optional display operations, which can be custom tailored to the requirements of a given user by merely changing the software used in microprocessor 12. In the preferred embodiment, four options are provided: loop inductance, $\delta L/L$ value, extension time control and a fast response option.

Option 3 operation (extension time control) proceeds as follows. When Option 3 is "OFF" the detector extends all calls for the programmed extension time. When Option 3 is "ON" the detector extends calls for the programmed extension time only when the associated phase is in green.

Option 4 operation (fast response) proceeds as follows. When Option 4 is "OFF" the detector operates with normal response time. When Option 4 is "ON" the detector operates in the fast response time mode. It is recommended that this mode only be "On" when the detector is used for speed or occupancy measurement applications.

Figure 4A:
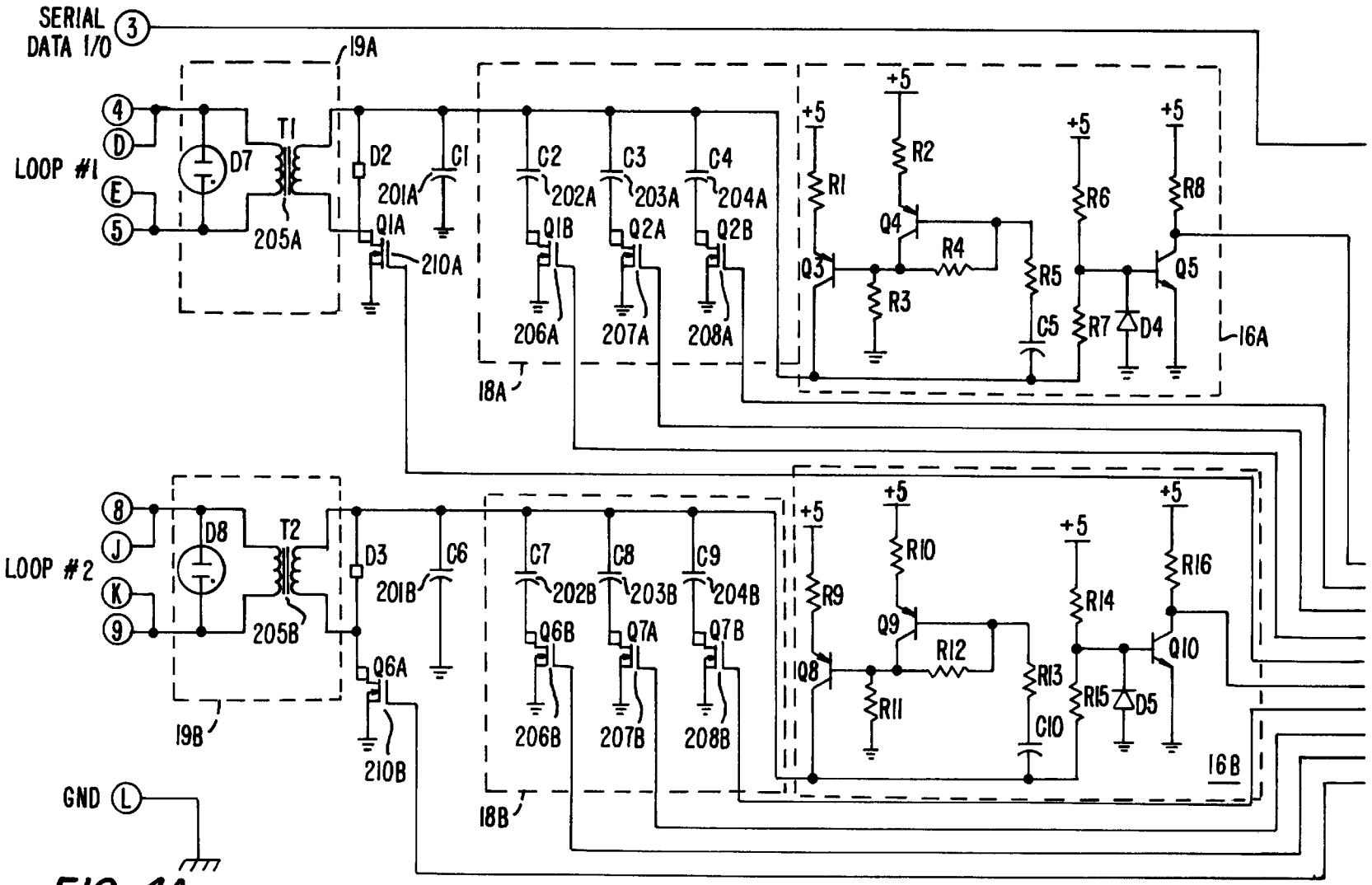
Figure 4B:
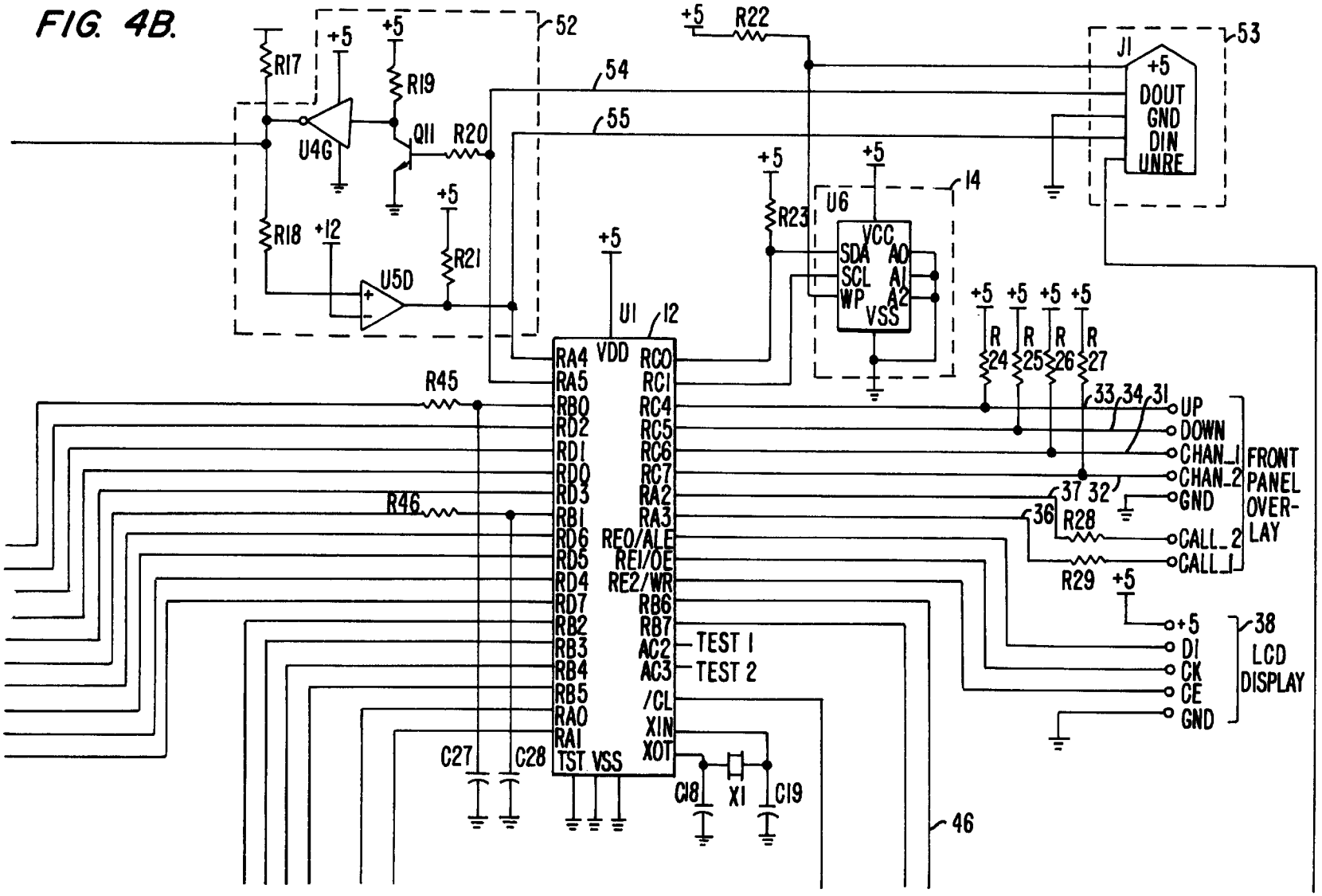
Figure 4C:
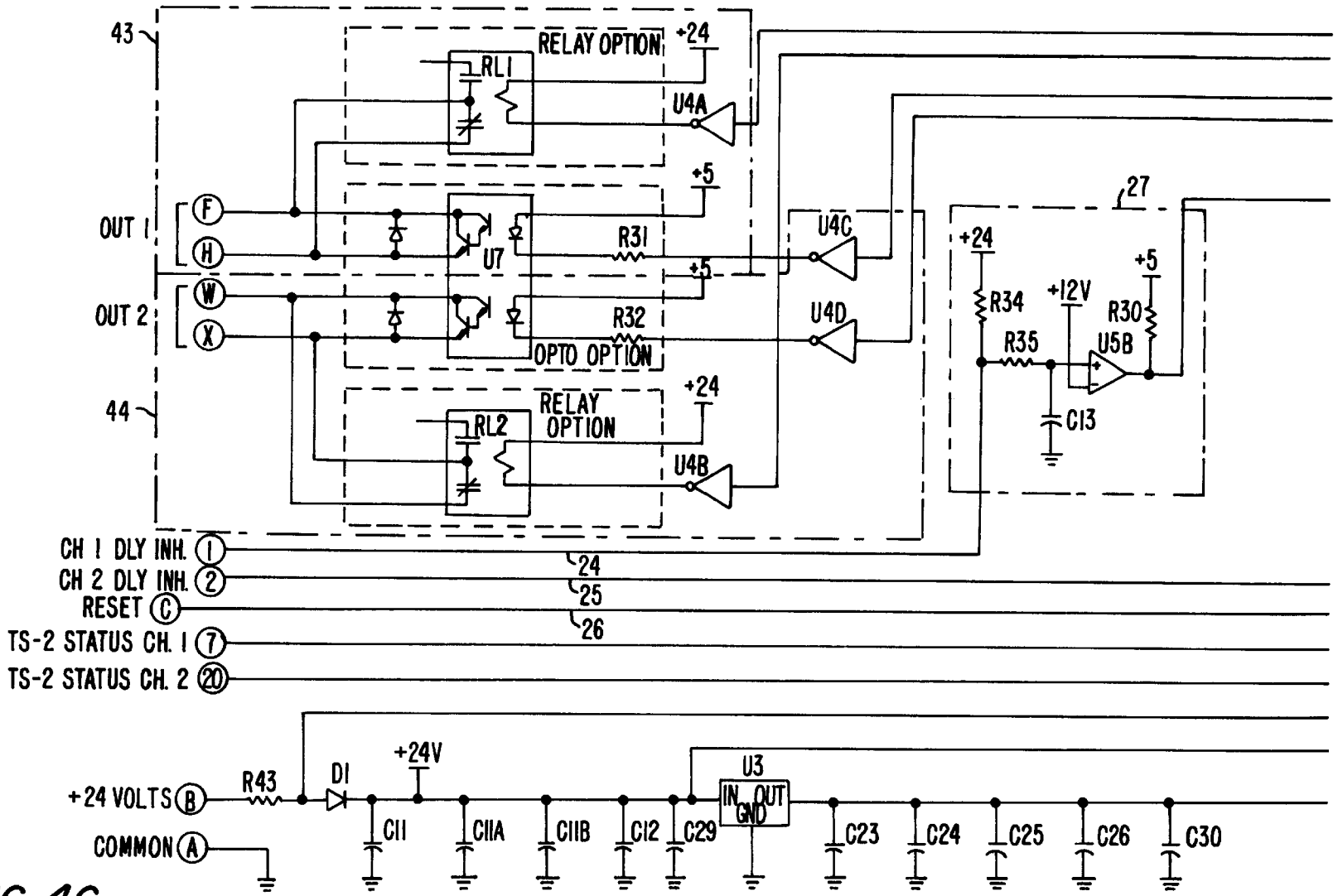
Figure 4D:
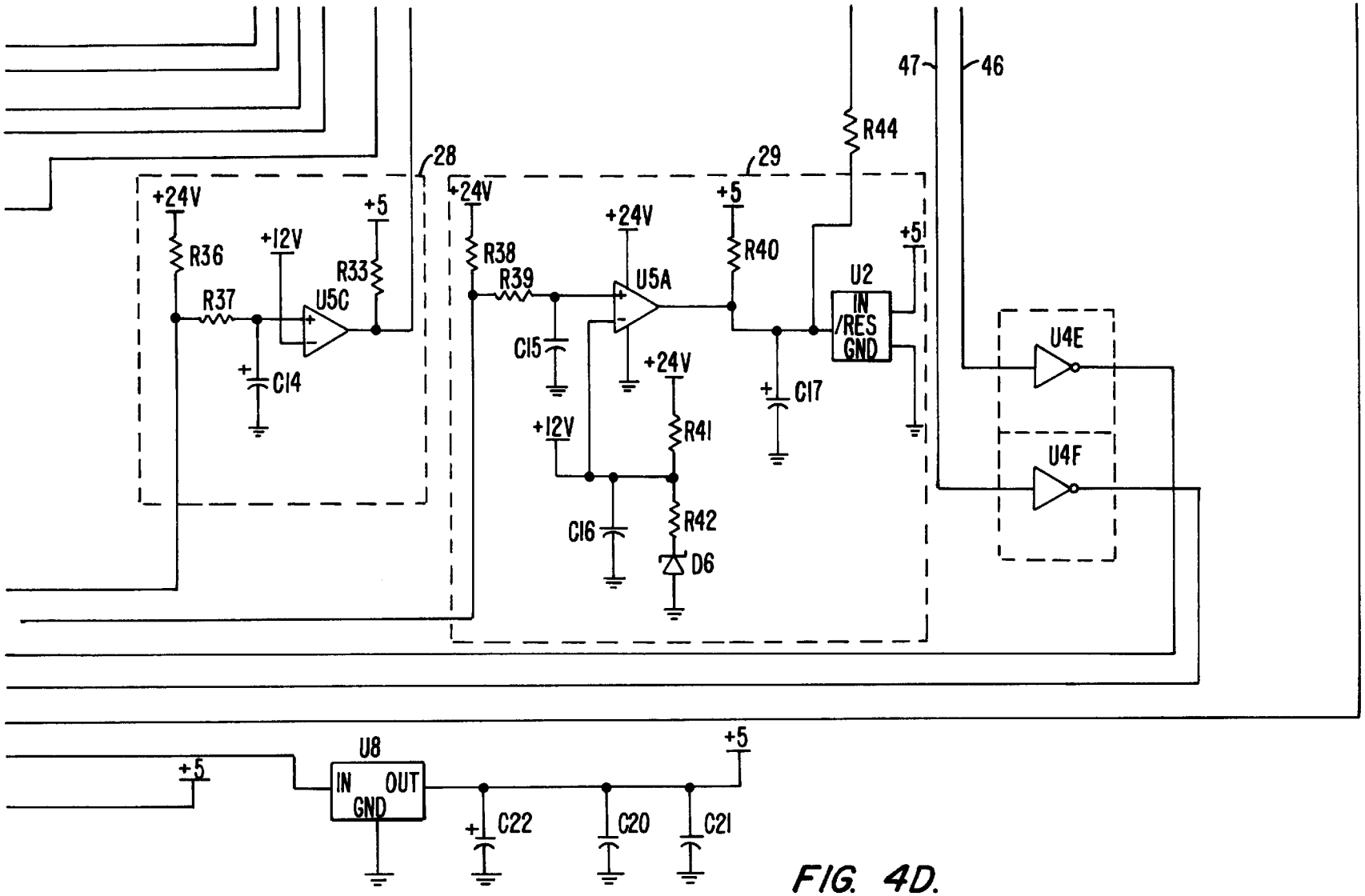

As noted above, non-volatile memory 14 is used to store certain parametric values and other information on a non-volatile basis. One use of this non-volatile storage is to preserve parametric and functional information selected by the operator when setting up the vehicle detector, including the state of the selectable functions (such as presence/pulse, maximum presence, scanning/non-scanning functions) and the selected values for the adjustable parameters (such as frequency, sensitivity, delay time, extension time, and maximum presence time). In addition, non-volatile memory 14 stores operational data resulting from the operation of the vehicle detector circuit, such as number and types of loop failures over a period of time. The period of time is specified by the software in microprocessor 12 and may be a period starting at the first activation of the vehicle detector to the present, a period of time defined by the microprocessor clock or some other time period (such as the time between successive full resets of the vehicle detector) of potential interest to the operator and/or manufacturer of the vehicle detector. In the case of loop failure information, the statistical or historical information is gathered as follows. After each detector channel is initialized and operating in a normal manner, the detector continuously monitors for faulty loop conditions (e.g. broken wires, poor splices, bad solder connections, etc.). If the measured loop inductance value rapidly changes by more than a predetermined relative amount (e.g. 25%), the channel is considered to have failed. The detector then enters the "Fail Safe" mode which generates a "Call" output. When the channel is in "Fail Safe" mode, "Loop Fail" messages 114, 115 located at the bottom of display 70 are illuminated. Also, the corresponding channel LED 66, 67 will repeat an eye-catching flash to alert the user to the problem. This LED flashing is latched (even if the loop recovers) until the user resets the channel or a power up occurs. At the time the channel enters "Fail Safe" mode, a loop fail register in microprocessor 12 is incremented by one count. The number of loop failures logged in the loop fail register can be observed by going through the procedure described above in step #10. The loop fail information (both the number of failures and the type of failure—e.g. open loop or shorted loop) is stored in non-volatile memory 14 by microprocessor 12. This information stored in memory 14 can be accessed by an authorized technician by connecting a test fixture to a test connector 53 (FIGS. 1 and 4B). Thus, memory 14 may contain a complete history of loop failures on a channel-by-channel basis for a specific vehicle detector. Such information can be of great diagnostic value in assessing the performance and reliability of a vehicle detector, and can eliminate the vehicle detector as a suspected source of functional failure—suggesting the need to examine the physical loop components (wires, cables, connectors, etc.) for mechanical or electrical failure or intermittent operation.

As noted above, the loop frequency is one of the selectable and settable parameters incorporated into the preferred embodiment. The manner in which the frequency of oscillator circuits 16A, 16B is changed is as follows. With reference to FIG. 4A, a plurality of capacitors 201–204 are connected with one plate tied in common to one terminal of a coil 205 in the isolation circuit 19. The other plate of each capacitor 201–204 is coupled either directly to ground (in the case of capacitor 201) or through one of a plurality of field effect transistor switches 206–208 (in the case of capacitors 202–204). Each of the field effect transistor switches 206–208 has a control element separately coupled to a control output terminal of microprocessor 12. As the operator steps through the individual discrete frequency settings, selected ones of switches 206–208 are enabled and disabled, thereby selectively inserting or removing capacitors 201–204 and thus changing the reactance of the oscillator circuit 16 and thus the frequency.

Since each FET switch 206–208 electrically isolates the associated capacitor 202–204 from ground when the FET switch is off, capacitors 202–204 are electrically removed from the oscillator circuit 16 when the oscillator is turned off by the microprocessor 12. Consequently, the frequency selection circuits 18A, 18B and oscillator circuits 16A, 16B do not influence each other when disabled during scanning mode.

As noted above, the preferred embodiment may be operated in either a scanning mode or a non-scanning mode by operator selection using switches 61–64. When in the non-scanning mode of operation, each oscillator circuit 16 is enabled by microprocessor 12 through an individual control line connected to a field effect transistor switch 210 which couples one terminal of coil 205 to ground. When operated in the scanning mode, oscillator circuits 19A and 19B are sequentially operated using the same field effect transistor switches 210A, 210B to alternately enable and disable oscillator circuits 16A, 16B.

As will now be apparent, vehicle detectors incorporating the invention provide a number of advantages over known vehicle detectors. Firstly, the combination of the switch programmability and operational display enable a technician to initially set up a vehicle detector at the site by selecting functions and parametric values using switches 61–64 and observing the display 70. When setting sensitivity, for example, the technician need only observe the bar segments 71–78 during normal display operation as a vehicle enters the loop detection zone and note the relative degree of activation of the individual segments 71–78 in response to the arrival of a normal vehicle in the loop associated with the channel being displayed. If only segment 71 is activated during normal display, the sensitivity is set too low and should be increased to ensure that a smaller vehicle (such as a motorcycle) will be reliably detected by the generation of a Call signal. This also serves as a diagnostic aid. For example, should the technician observe a relatively large degree of illumination of segments 71–78 by the arrival of a vehicle in an adjacent lane, this signifies that substantial cross talk exists. If this condition cannot be remedied by reducing the sensitivity, the technician can report this as a loop installation problem which needs to be addressed. Thus, the vehicle detector can also be used as a diagnostic aid to infer the integrity of the loop without physically or visibly inspecting the loop. In addition, Options 1 and 2 enable a technician to measure both loop frequency and $\Delta L/L$ directly from display 70, thus eliminating the need for a loop diagnostic tool, such as a loop analyzer, to measure these parameters. Further, by providing a wide range in the potential values of the selectable parameters, vehicle detectors incorporating the invention provide an application flexibility hitherto unattainable by known vehicle detectors. Moreover, by providing non-volatile storage of selected information—such as cumulative number and types of loop failure—the invention provides useful historical operational information for both performance evaluation and reliability assessment. In addition, by providing the selectable scanning/non-scanning functions, a single vehicle detector may be used in either application without the need for physical alteration of the vehicle detector. Lastly, the frequency selection circuit minimizes cross talk with adjacent loops.

A copy of a hexadecimal listing of the program code incorporated in microprocessor 12 for the functions described above to be executed is attached as Appendix I.

While the above provides a full and complete disclosure of the preferred embodiments of the invention, various modifications, alternate constructions and equivalents will occur to those skilled in the art. For example, while the invention has been described with reference to a two-channel detector, additional configurations are intended having more channels (e.g. three or four), or a single channel. Also, many other types of information can be accumulated in non-volatile memory 14 for subsequent extraction and analysis, such as number of vehicles counted in a counting installation over preselected periods, percentage of vehicles passing a loop over a given period at a speed above or below some predetermined threshold, the length of the longest Call signal over a given period, and the like. Therefore, the above should not be construed as limiting the invention, which is defined by the appended claims.

What is claimed is:

1. A vehicle detector comprising:

means for detecting the occupancy state of a loop detection zone;

manually actuatable flnction switches coupled to said detecting means for enabling operator control of function state selection and selection of any one of a plurality of vehicle detector parameter values; and a variable display device coupled to said detecting means for displaying selected function states, the identification of a selected vehicle detector parameter, and the actual value of a vehicle detector parameter selected by at least one of said function switches.

2. The vehicle detector of claim 1 wherein said detecting means includes a microprocessor.

3. The vehicle detector of claim 1 wherein said display device includes a liquid crystal display.

4. The vehicle detector of claim 1 wherein the selected vehicle detector parameter is relative sensitivity of said loop detection zone.

5. The vehicle detector of claim 1 wherein the selected vehicle detector parameter is loop frequency.

6. The vehicle detector of claim 1 wherein the selected vehicle detector parameter is loop inductance.

7. The vehicle detector of claim 1 wherein the selected vehicle detector parameter is loop inductance change in percentage caused by the entry of a vehicle into said loop detection zone.

8. The vehicle detector of claim 1 wherein the selected vehicle detector parameter is delay time before a call signal is generated.

9. The vehicle detector of claim 1 wherein the selected vehicle detector parameter is maximum presence time.

10. The vehicle detector of claim 1 wherein the selected vehicle detector parameter is extension time before a call signal is dropped.

11. The vehicle detector of claim 1 wherein said selected function states include pulse mode and presence mode of operation.

12. The vehicle detector of claim 1 wherein said selected function states include scanning mode and non-scanning mode of operation.

13. The vehicle detector of claim 1 wherein said selected function states include end-of-green function.

14. A variable vehicle detector display for facilitating operator control of function state selection, vehicle detector parameter selection, and vehicle detector parameter value selections, said display comprising:

a first variable display portion including a plurality of individually activatable bar-like segments together defining a bar graph for displaying the relative magnitude of at least one vehicle detector parameter;

a second variable display portion having a plurality of character regions for displaying actual values of at least one vehicle detector parameter; and a third display portion having a plurality of individually activatable message indicators for indicating a selected parameter whose actual value is being displayed by said second portion.

15. The display of claim 14 wherein said at least one vehicle detector parameter comprises the inductance of a loop associated to a vehicle detector containing said display.

16. The display of claim 14 wherein said multiple segment displays are seven-segment liquid crystal display characters.

17. The display of claim 14 wherein said display comprises a liquid crystal device.

18. The vehicle detector display of claim 14 wherein said first display portion bar-like segments also indicate the relative magnitude of a selected vehicle detector parameter.

19. The vehicle detector display of claim 18 wherein the selected vehicle detector parameter displayed by said second portion is the inductance change in percentage caused by the entry of a vehicle into an oscillator loop associated with said vehicle detector display.

20. The vehicle detector display of claim 14 wherein said plurality of alpha-numeric character regions include multiple segment display regions.

21. The vehicle detector display of claim 14 wherein at least some of said message indicators indicate function state selection.

22. The vehicle detector display of claim 14 wherein said display is associated with a multiple channel vehicle detector; and wherein said display flier includes a fourth display portion for indicating a selected channel.

23. The vehicle detector display of claim 14 wherein the selected vehicle detector parameter displayed by said second portion is inductance of an oscillator loop associated with said vehicle detector display.

24. The vehicle detector display of claim 14 wherein the selected vehicle detector parameter displayed by said second portion is frequency of an oscillator loop associated with said vehicle detector display.

25. The vehicle detector display of claim 14 wherein the selected vehicle detector parameter displayed by said second portion is delay time before a call signal is generated by a vehicle detection means associated with said vehicle detector display.

26. The vehicle detector display of claim 14 wherein the selected vehicle detector parameter displayed by said second portion is maximum presence time permitted by a vehicle detection means associated with said vehicle detector display.

27. The vehicle detector display of claim 14 wherein the selected vehicle detector parameter displayed by said second portion is extension time before a call signal is dropped by a vehicle detection means associated with said vehicle detector display.

28. The vehicle detector display of claim 14 wherein said selected function states indicated by said third portion include pulse mode and presence mode of operation of a vehicle detection means associated with said vehicle detector display.

29. The vehicle detector display of claim 14 wherein said selected function states indicated by said third portion include scanning mode and non-scanning mode of operation of a vehicle detection means associated with said vehicle detector display.

30. The vehicle detector display of claim 14 wherein said selected function states indicated by said third portion include end-of-green function performed by a vehicle detection means associated with said vehicle detector display.

31. A vehicle detector comprising:

means for detecting the occupancy state of a loop detection zone;

at least two manually actuatable function switches coupled to said detecting means for enabling operator control of function state selection, selection of any one of a plurality of vehicle detector parameters, and vehicle detector parameter value selection; and a variable display device coupled to said detecting means for indicating a selected parameter and the actual value of a parameter selected by at least one of said function switches.

32. The vehicle detector of claim 31 where said display device includes a first display portion having a plurality of character display regions for indicating values of at least one vehicle detector parameter, and a second display portion having a plurality of individually activatable message indicators for indicating a selected parameter.

33. The vehicle detector of claim 31 wherein said selected parameter is relative sensitivity of said loop detection zone; and wherein said display device includes means for displaying the sensitivity value.

34. The vehicle detector of claim 33 wherein said means for displaying the sensitivity value comprises a display region having selectively activatable indicators for providing a graph-like indication of sensitivity.

35. The vehicle detector of claim 31 wherein said means for detecting the occupancy state comprises a multiple-channel detection means; and wherein said display device further includes means for indicating an active channel.

36. The vehicle detector of claim 31 wherein the selected vehicle detector parameter is loop frequency.

37. The vehicle detector of claim 31 wherein the selected vehicle detector parameter is loop inductance.

38. The vehicle detector of claim 31 wherein the selected vehicle detector parameter is loop inductance change in percentage caused by the entry of a vehicle into said loop detection zone.

39. The vehicle detector of claim 31 wherein the selected vehicle detector parameter is delay time before a call signal is generated.

40. The vehicle detector of claim 31 wherein the selected vehicle detector parameter is maximum presence time.

41. The vehicle detector of claim 31 wherein the selected vehicle detector parameter is extension time before a call signal is dropped.

42. The vehicle detector of claim 31 wherein said selected function states include pulse mode and presence mode of operation.

43. The vehicle detector of claim 31 wherein said selected function states include scanning mode and non-scanning mode of operation.

44. The vehicle detector of claim 31 wherein said selected function states include end-of-green function.

* * * * *

UNITED STATES PATENT AND TRADEMARK OFFICE

CERTIFICATE OF CORRECTION

PATENT NO. : 6,087,964

DATED : July 11, 2000

INVENTOR(S) : Allen et al

It is certified that error appears in the above-identified patent and that said Letters Patent is hereby corrected as shown below:

Title page item [57],

Abstract, in line 13 before "Call" insert-a-

Abstract, in line 14 before "signal" cancel-a-

In column 17, line 29 cancel "flier" and insert-further-

Signed and Sealed this

Seventeenth Day of April, 2001

*Attest:*

Nicholas P. Godici

NICHOLAS P. GODICI

*Attesting Officer*

*Acting Director of the United States Patent and Trademark Office*